US009945624B2

(12) United States Patent
Guerini

(10) Patent No.: US 9,945,624 B2
(45) Date of Patent: Apr. 17, 2018

(54) FIREARM AND FIREARM KIT

(71) Applicant: Caesar Guerini S.r.l., Marcheno (IT)

(72) Inventor: Antonio Guerini, Marcheno (IT)

(73) Assignee: CAESAR GUERINI S.R.L. (IT)

( * ) Notice: Subject to any disclaimer, the term of this patent is extended or adjusted under 35 U.S.C. 154(b) by 105 days.

(21) Appl. No.: 14/588,727

(22) Filed: Jan. 2, 2015

(65) Prior Publication Data

US 2015/0184957 A1 Jul. 2, 2015

(30) Foreign Application Priority Data

Jan. 2, 2014 (IT) ..... BS2014A0001

(51) Int. Cl.

| | |
|---|---|
| ***F41C 7/00*** | (2006.01) |
| ***F41A 3/06*** | (2006.01) |
| ***F41A 3/58*** | (2006.01) |
| ***F41C 7/11*** | (2006.01) |

(52) U.S. Cl.
CPC *F41A 3/06* (2013.01); *F41A 3/58* (2013.01); *F41C 7/11* (2013.01)

(58) Field of Classification Search
CPC ..... F41A 3/06; F41A 3/58; F41C 7/11
See application file for complete search history.

(56) References Cited

U.S. PATENT DOCUMENTS

| | | | | |
|---|---|---|---|---|
| 149,352 A | | 4/1874 | Sneider | |
| 198,670 A | | 12/1877 | Nichols | |
| 226,893 A | | 4/1880 | Van Gieson | |
| 227,907 A | | 5/1880 | Livingston | |
| 241,466 A | | 5/1881 | Wilson | |
| 375,626 A | | 12/1887 | Hampton | |
| 766,231 A | | 8/1904 | Elterich | |
| 1,004,269 A | * | 9/1911 | Jager | F41A 3/58 42/40 |
| 1,054,069 A | * | 2/1913 | Wilson | F41A 3/58 42/41 |
| 1,312,170 A | | 8/1919 | Flues | |
| 4,354,322 A | * | 10/1982 | Carone | F41C 7/11 411/24 |

(Continued)

FOREIGN PATENT DOCUMENTS

| | | | |
|---|---|---|---|
| DE | 3426229 A1 | 1/1986 | |
| FR | 460768 A | 12/1913 | |

(Continued)

OTHER PUBLICATIONS

Italian Search Report in IT BS20140001 dated Sep. 15, 2014.

*Primary Examiner* — Gabriel Klein
(74) *Attorney, Agent, or Firm* — Henry J. Cittone; Cittone Demers & Arneri LLP

(57) ABSTRACT

The firearm comprises a firearm frame, a barrel sleeve mounted in a rotatable manner on the firearm frame, and at least one rotation pin which extends between the firearm frame and the barrel sleeve to guide the sleeve around a rotation axis. The rotation pin and the firearm frame, or said pin and the barrel sleeve, lie in abutment with each other by means of complementary sliding surfaces, at least one sliding surface being borne by a wear component connected in a releasable manner to the rotation pin, to the firearm frame and/or to the barrel sleeve. The invention also relates to a kit for a firearm.

14 Claims, 8 Drawing Sheets

(56) References Cited

U.S. PATENT DOCUMENTS

| | | | | | |
|---|---|---|---|---|---|
| 4,541,192 | A * | 9/1985 | Flodman | F41C 7/11 | 42/40 |
| 2004/0103575 | A1* | 6/2004 | Rousseau | F41A 3/58 | 42/75.02 |
| 2004/0144008 | A1* | 7/2004 | Popikow | F41C 7/11 | 42/40 |

FOREIGN PATENT DOCUMENTS

| | | | | |
|---|---|---|---|---|
| FR | 552254 | A | | 4/1923 |
| FR | 2312753 | A | * | 5/1975 |
| GB | 191109203 | A | | 9/1911 |

* cited by examiner

FIREARM AND FIREARM KIT

CROSS-REFERENCE TO RELATED APPLICATIONS

This application claims priority to Italian Patent Application No. BS2014A000001, filed Jan. 2, 2014, the disclosure of which is hereby incorporated by reference in its entirety.

BACKGROUND OF THE INVENTION

1. Field of the Invention

The present invention relates to a firearm, and to a kit for a firearm.

2. Description of the Prior Art

From the publication U.S. Pat. No. 5,433,027 a combined rifle is known of with a pair of barrels hinged to a main body to allow the rear-loading of ammunition. The firearm described in this document sets out to reduce the level of wear acting on the body-barrel hinge pin by means of an abutment made on the frame (in this regard see FIGS. 28 and 29 of the publication), which acts in conjunction with corresponding shoulders positioned on the barrels.

Despite such set-up being an improvement from some points of view, such a technical solution in any case suffers from some drawbacks.

In particular, manufacturing tolerances do not allow to prevent the hinge pin from being completely freed from the firing forces, so that the solution proposed in U.S. Pat. No. 5,433,027 makes it possible to delay, but not to prevent, the need to replace said pin.

In addition, the inexorable consumption of the material of the pin causes a progressive displacement of the rotation axis which results, after a certain number of shots have been fired, in the abutment of the body frame failing to couple precisely with the shoulders of the barrels.

The present invention falls within this context, proposing to provide a firearm with a construction such as to compensate for the wear acting on the rotation pin, and such as to allow a lengthening of the useful life of the firearm.

SUMMARY OF THE INVENTION

Such objective is achieved by a firearm comprising a firearm frame, a barrel sleeve extending in a longitudinal direction and mounted in a rotatable manner on the firearm frame, and at least a rotation pin which extends between the frame and the sleeve to guide the sleeve around a rotation axis. The rotation pin and the firearm frame, or said pin and the barrel sleeve, lie in abutment with each other by means of complementary sliding surfaces, at least one sliding surface being carried by a wear component connected in a releasable manner to the rotation pin, to the firearms frame and/or to the barrel sleeve.

Such objective is also achieved by a firearm kit comprising one or more wear components suitable to be connected in a releasable manner to a rotation pin, to a firearm frame and/or to a barrel sleeve of the firearm according to any of the discussed embodiments, and one or more removable abutments for such firearm.

The dependent claims show preferred embodiments.

BRIEF DESCRIPTION OF THE DRAWINGS

The object of the present invention will now be described in detail, with the help of the attached drawings, wherein.

DESCRIPTION OF THE PREFERRED EMBODIMENT

Figure 1:
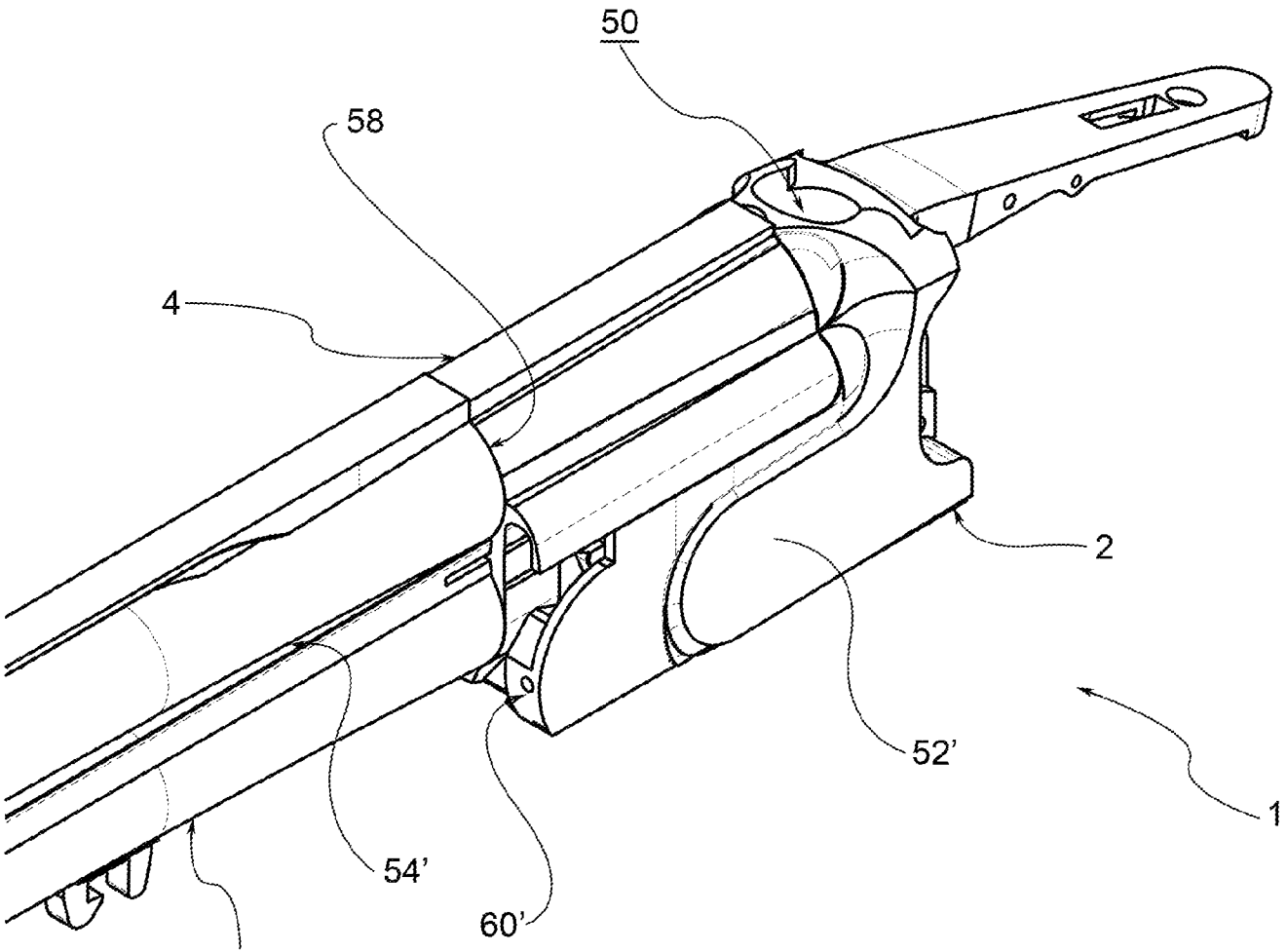
FIGS. 1 and 2 respectively show two perspective views from different angles of a firearm according to the present invention according to one embodiment, where the frame of the firearm in FIG. 2 is partially in cross-section at the rotation pin and where the relative butt has been omitted for greater clarity.
Figure 2:
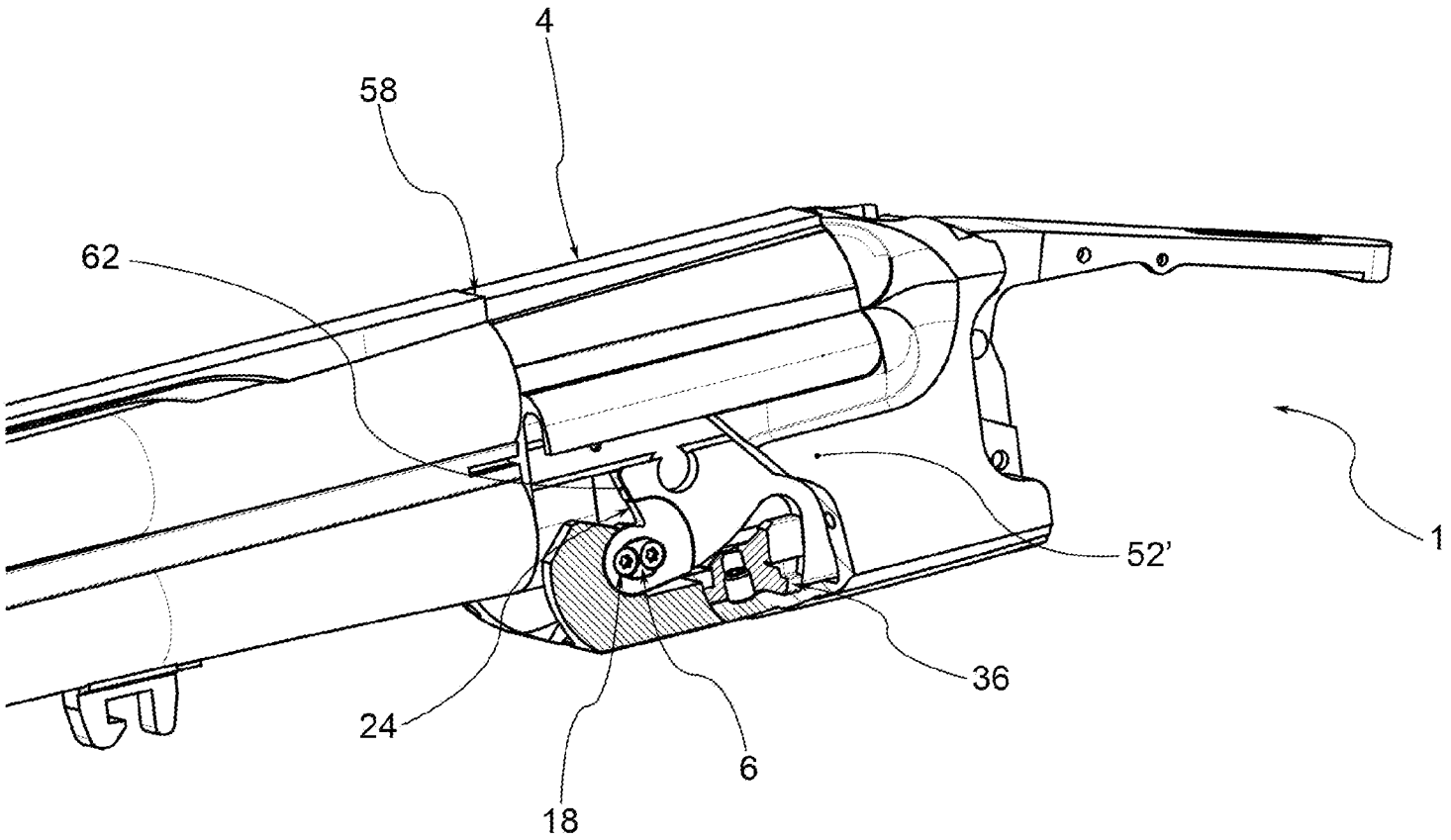

With reference to the aforesaid drawings, reference numeral 1 globally denotes a firearm.

In the embodiments shown, the firearm is a rifle. For example, such rifle may have two or three-barrels side by side or superposed, or it could be a single-barreled rifle. The invention must not however be considered limited to the embodiment shown in the figures, provided purely by way of a non-limiting example.

The firearm 1 comprises a firearm frame 2 and a barrel sleeve 4, which extends in a longitudinal direction X and which is mounted in a rotatable manner on the firearm frame 2.

In the embodiments shown, the longitudinal direction X of the sleeve 4 and the relative axis of rotation R with respect to the firearm frame are mutually incident (preferably orthogonal), at least in projection. For example, the barrel sleeve defines one or more firing chambers 30, 30' from which one or more firearm barrels 54, 54' extend frontally.

Preferably, the barrel sleeve 4 is hinged to the firearm frame in an end (distal) position 2' of the frame. Preferably, the firearm frame comprises a so-called "receiver".

Advantageously, the barrel sleeve 4 is hinged to the aforesaid frame in an end position 4' of said sleeve, preferably in a position 4' "upstream"—in a shooting direction S—of a connection zone 58 of the at least one firearm barrel 54, 54' to the sleeve.

In an alternative embodiment, at least one arm 48 for the connection of a butt (not shown) extends rearwards from the firearm frame—i.e. in the opposite direction to the direction in which the barrel sleeve 4 extends.

Preferably, the firearm frame 2 delimits a frame compartment 46 inside which the barrel sleeve 4 is at least partially housed in at least one of its operating configurations, preferably in both the configurations illustrated below.

More specifically, the firearm frame comprises a pair of side panels 52, 52' which, together with a bottom wall 20 and an inner surface 28 facing the barrel sleeve 4, delimit the firearm compartment 46, into which the sleeve is inserted so as to rotate. Preferably, the side panels are connected and extend from the bottom wall 20, for example at right angles.

According to one variant, the inner surface 28 is crossed by at least one transit opening 74 for a firing pin (not shown), operatively connected to a firing device. Preferably, the number of transit openings 74, and thus of firing pins, is equal to the number of firing chambers 30, 30' of the firearm.

Advantageously, the barrel sleeve 4 is rotatable in relation to the firearm frame 2 between a closed configuration and an open configuration: in the first of such configurations (FIG. 3), the barrel sleeve 4 and the inner surface 28 of the firearm frame 2 act in conjunction to close at least one firing chamber 30, 30' of the firearm 1. Conversely, in the second of the aforementioned configurations (FIG. 4), the sleeve 4 is distanced from the inner surface 28, so that the firing chamber 30, 30' is accessible, for example to load the firearm 1 or to remove the casings of the cartridges already fired.

Optionally, associated with the frame 2 of the firearm a constraint device may be provided configured to hold the barrel sleeve 4 in the closed configuration. This constraint device has been omitted from the figures, but one embodiment provides that an actuating lever of such device protrudes from the top of the frame 2, and in particular is at least partly housed in a device seat 50, represented in the drawings, of said frame 2. Consequently, according to one embodiment, the actuating lever is at least partially superposed vertically with the connecting arm 48.

The firearm 1 further comprises at least one rotation pin 6, 6', which extends between the firearm frame 2 and the barrel sleeve 4 to guide the sleeve around the rotation axis R. For example, the embodiments of the figures show a rotation pin 6, 6' with an ellipsoidal or ovoid cross-section.

Figures 6, 6A:
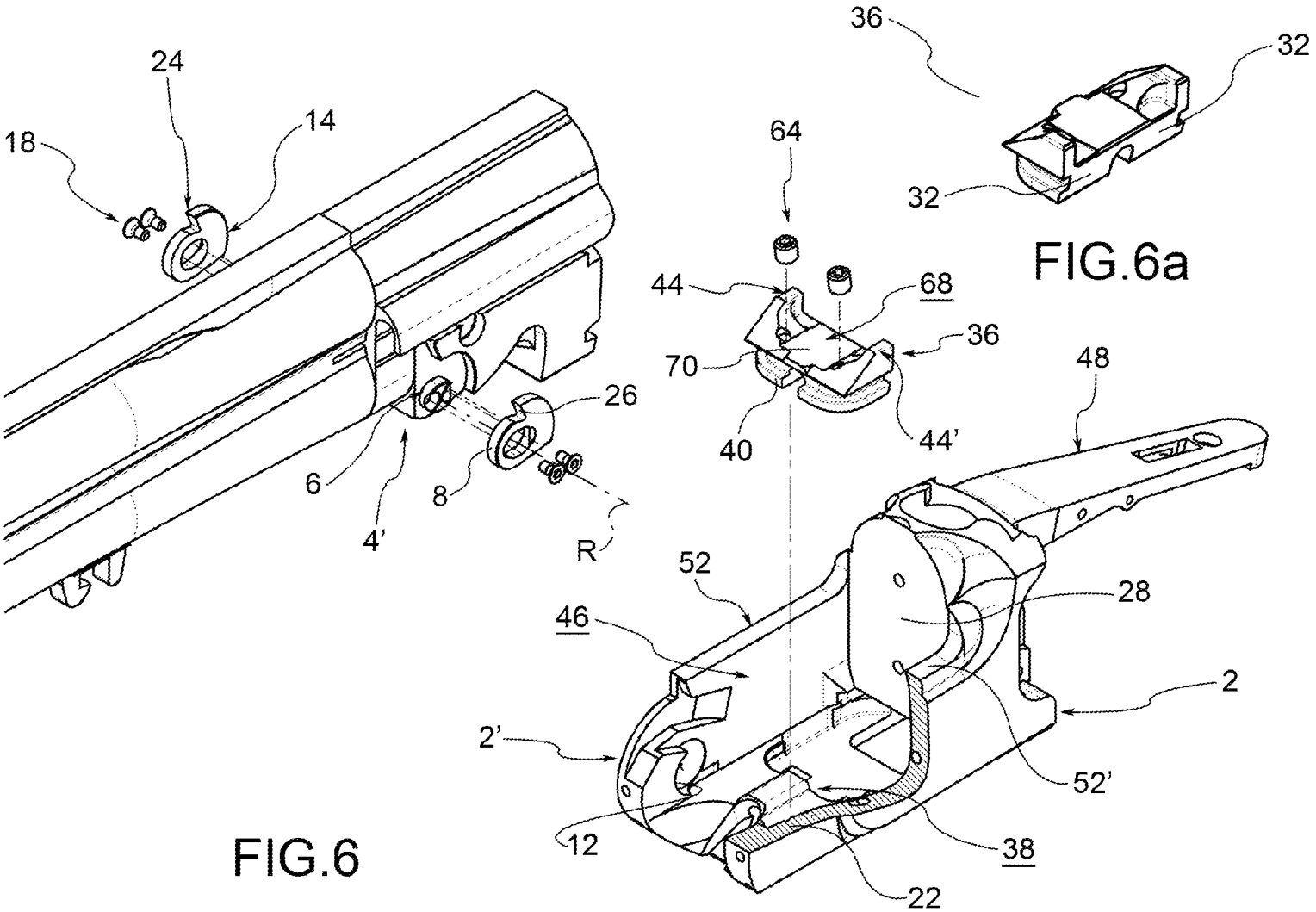
FIG. 6*a* shows a perspective view, opposite that shown in the previous FIG. 6, of a removable abutment.
Figure 7:
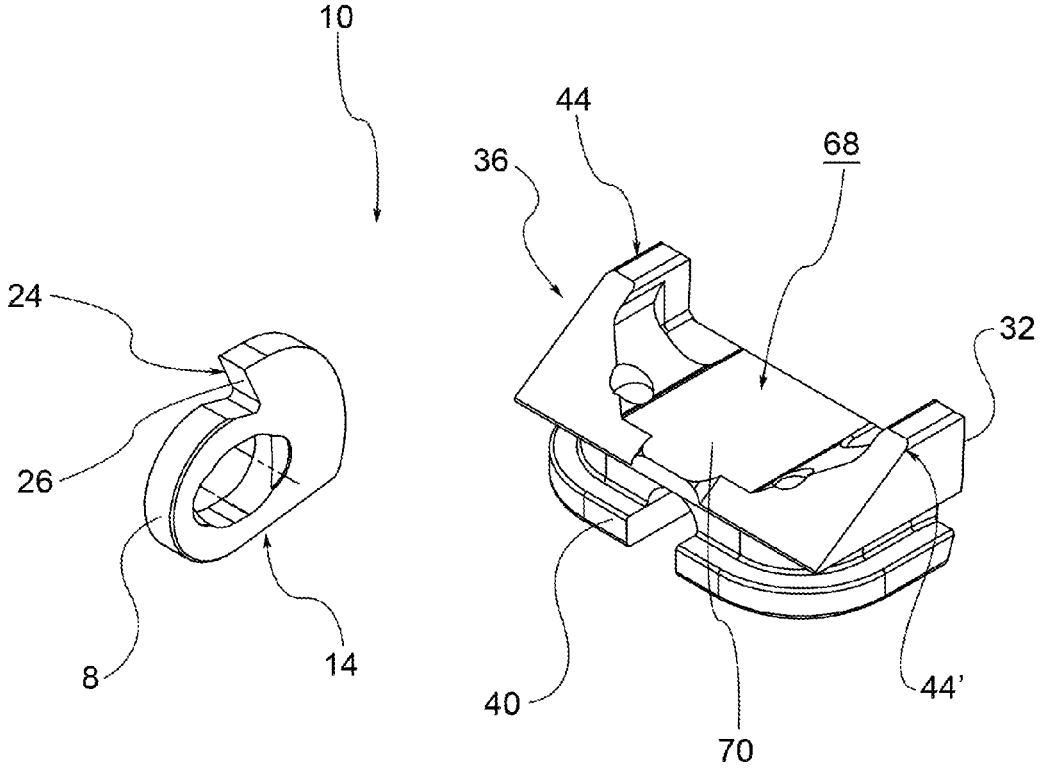
FIG. 7 shows a firearm kit according to a possible variant.
Figure 8:
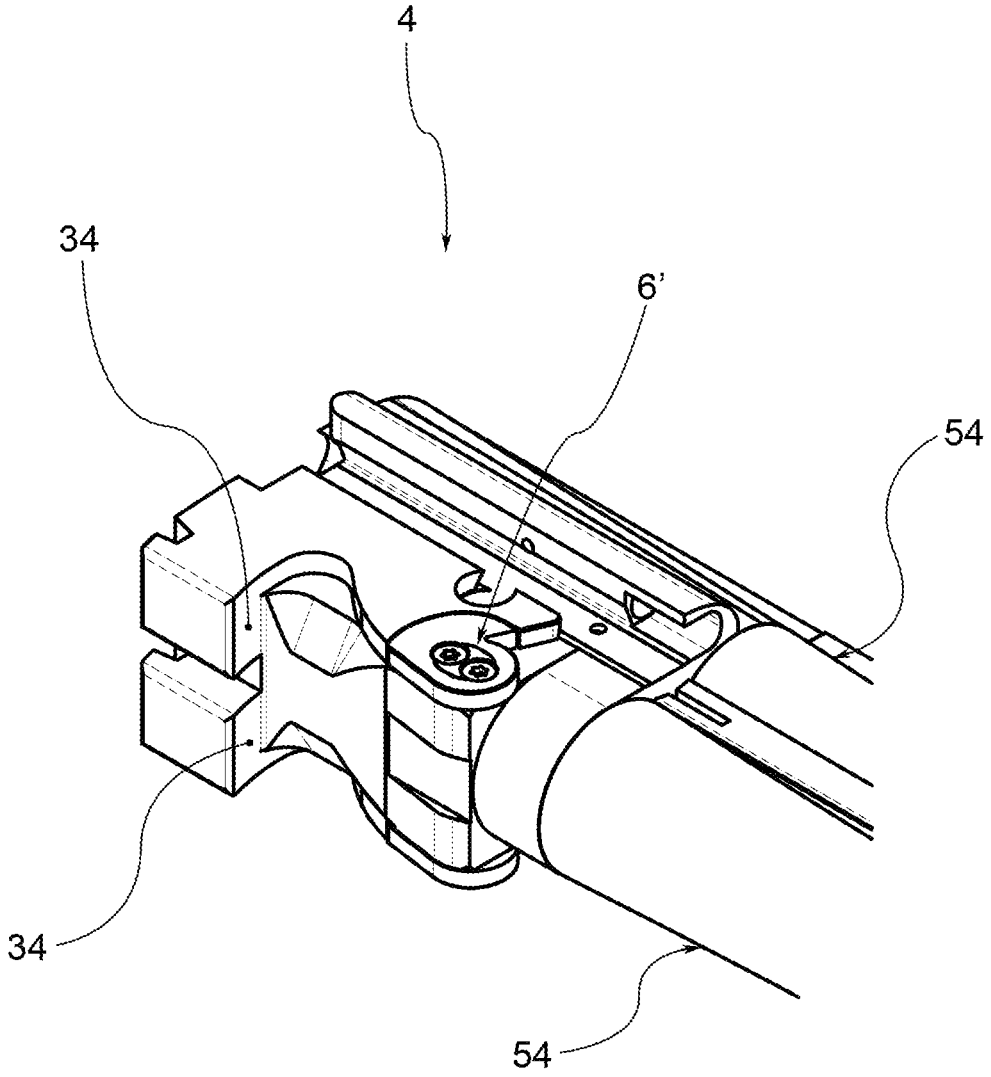
FIG. 8 is a view from underneath of the barrel sleeve according to a possible embodiment.

In the embodiment shown for example in FIG. 6, a pair of rotation pins 6 are provided positioned on opposite sides of the firearm 1, in particular facing the side panels 52, 52'. One of such pins is visible in FIG. 6, the other in FIG. 8.

According to one embodiment, the rotation pin 6, 6' is made in one piece with the barrel sleeve 4, or with the firearm frame 2.

Consequently, the rotation pin 6, 6' and the firearm frame 2, or the pin 6, 6' and the barrel sleeve 4, lie in abutment with each other by means of complementary sliding surfaces 8, 12, so as to allow and guide the rotations of the sleeve 4. At least one sliding surface 8 is borne by a wear component 14 detachably connected to the rotation pin 6, 6', to the firearm frame 2 and/or to the barrel sleeve 4.

It follows that, during the rotation of the sleeve between the configurations discussed above, but especially during firing operations, the resulting stresses will be borne primarily by the wear component 14 which, as mentioned, is an easily replaceable element of the firearm 1.

In other words, when the amount of wear of the sliding surfaces 8, 12 is such as to no longer allow satisfactory closure of the firing chamber (in that the firing gases escape for example from between the inner surface 28 and a mouth 56 of such chamber), a worn or deformed wear component 14 may be replaced with a new component 14, so as to restore acceptable operating conditions.

In yet other words, since the recoil forces generated by firing tend to spread the firearm frame and the barrel sleeve apart, and since those forces are discharged essentially exclusively on the rotation pin, in the presence of the wear component 14 one or both sliding surfaces 8, 12 can be reconstituted which will thus allow a reliable rotation of the barrel sleeve 4.

For example, the material which the wear component is composed of is the same as that which the firearm frame is made of, or is a material of a hardness at least comparable to said frame.

Preferably, the wear component 14 has variable dimensions to correct or regulate the lever arm of the barrel sleeve 4, for example following wear of the aforementioned sliding surfaces 8, 12.

Even more preferably, with respect to the rotation axis R, the wear component 14 forms a predefined radial thickness 16 to correct or regulate the distance between the sliding surface 8 thereof and the rotation axis R.

It follows that, since the forces of abrasion or recoil acting on the sliding surfaces 8, 12 tend to produce a progressive shift/advancement of the rotation axis R, the use of a suitable wear component 14 makes it possible to reposition the aforementioned lever arm or the aforementioned distance.

Advantageously, the firearm comprises releasable attachment means 18 of the wear component 14 to the rotation pin 6, 6', to the firearm frame 2 and/or to the barrel sleeve 4.

Figure 5:
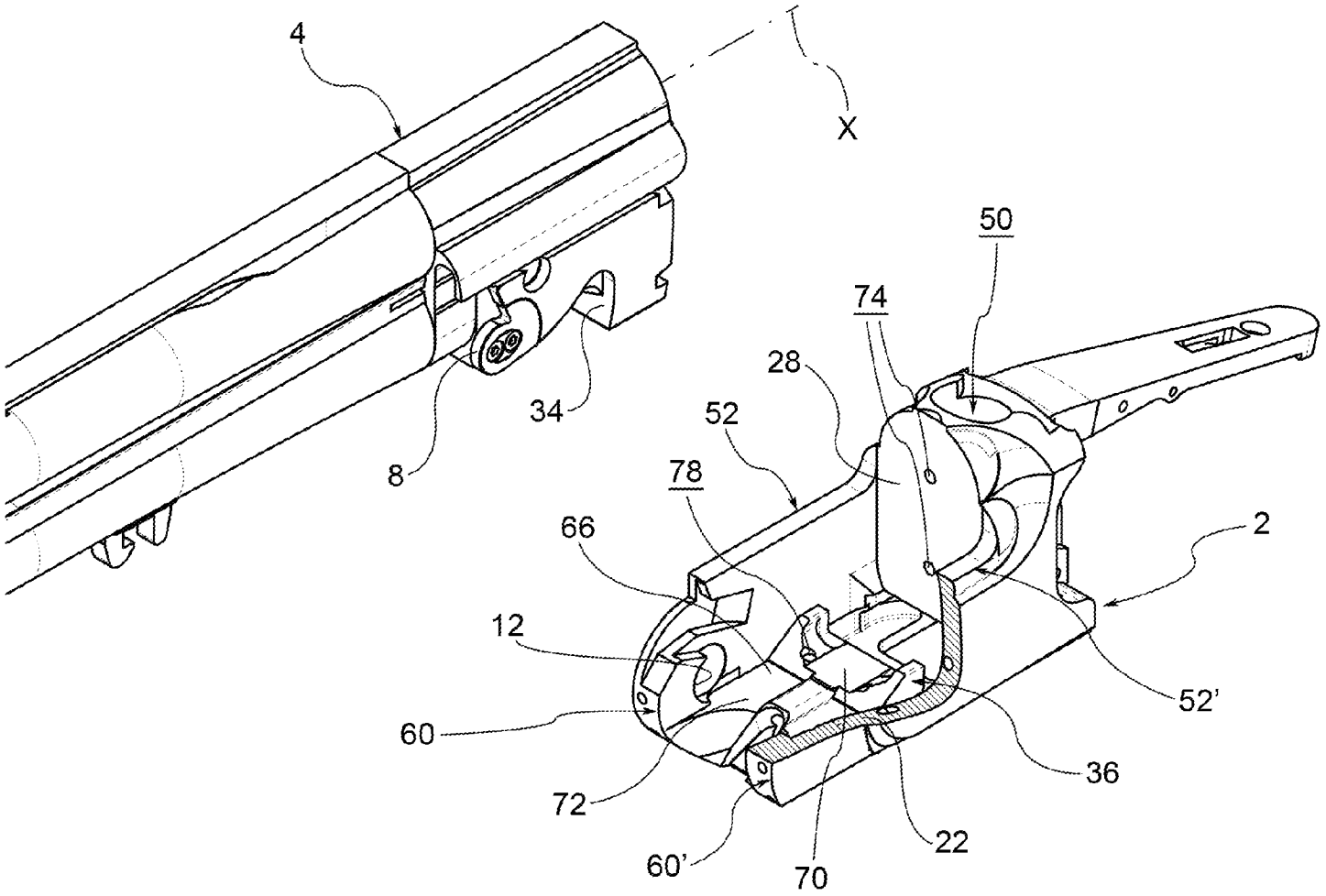
FIGS. 5 and 6 are views with separated parts of the firearm shown in FIG. 2.

Preferably, such means are accessible when the barrel sleeve is dismantled from the firearm frame, for example as represented in FIG. 5.

In the embodiment shown, the releasable attachment means 18 comprise at least one screw, preferably a pair of screws placed side by side. For example, such screw is screwed into the rotation pin 6, 6'.

According to one variant, the wear component 14 is joined to the rotation pin 6, 6'.

Preferably, the wear component 14 is shape-coupled to the pivot pin 6, 6', or to the firearm frame 2, to form a prismatic coupling therewith.

Advantageously, the wear component 14 is integral in rotation with the barrel sleeve.

According to one embodiment, the wear component 14 is partially hollow to accommodate at least a part of the rotation pin 6, 6'.

For example with reference to the variant shown in the drawings, said component 14 is of a generally annular shape, so that it can be fitted onto the rotation pin 6, 6', for example coaxially to the rotation axis R.

According to one embodiment, the sliding surface 8 borne by the wear component 14 works on an opposite sliding surface 12 made in one piece with the firearm frame 2, or on the barrel sleeve 4.

For example, the opposite sliding surface 12 is concave, so as to house part of the wear component and, optionally, a part of the rotation pin.

For the variants which provide for side panels 52, 52', the opposite sliding surface could be a swiveling cuff 60, 60', which protrudes from the respective panel towards the compartment of the frame 46. For example a pair of swiveling cuffs 60, 60' may be provided staggered along the rotation axis R.

According to one embodiment, the wear component 14 comprises at least one tooth 24 projecting in a radial direction—relative to the rotation axis R—which delimits a tooth surface 26 alongside an end-stroke surface 62 of the barrel sleeve 4 on the firearm frame 2, to limit the angle of rotation of the aforesaid sleeve.

Specifically, the tooth surface 26 is slightly rearward relative to the end-stroke surface 62, so as to avoid a contact with the frame in any operating configuration of the firearm.

According to a particularly advantageous embodiment, the barrel sleeve 4 and the firearm frame 2 define opposite retention surfaces 32, 34 which, when the sleeve is placed in the closed configuration, interact to hold the sleeve in a firing direction S of the firearm 1.

It follows that the retaining action of these surfaces 32, 34 contributes to reducing the mechanical stresses on the rotation pin 6, 6', and thus delays the need to replace the wear component.

Preferably, at least one of the aforementioned surfaces 32 is defined by a removable abutment 36, advantageously shaped in a manner corresponding to the wear component 14.

This means that the removable abutment 36 can also be replaced in the firearm and this has important consequences not just for the maintenance of the same, but also in its production.

In fact, in order to calibrate a correct closure of the at least one firing chamber, it is possible to select the wear component 14 geometrically most suitable. The longitudinal displacement which such component produces on the barrel sleeve must therefore also be compensated for the placement of the removable abutment 36, for variants providing for such: an overly forward or rearward retention surface 32 (for example in the longitudinal direction X—when the barrel sleeve is in the closed configuration) would result in an inaccurate coupling with the twin surface 34.

Therefore, to also take into account the production tolerances of the barrel sleeve, of the firearm frame and of the rotation pin, the use of the removable abutment makes it possible to considerably simplify the assembly or reassembly of the firearm.

According to one advantageous embodiment, the removable abutment 36 is placed in a seat 38 of the firearm frame 2 at a fixed radial distance from the rotation axis R, but the retention surface 32 of said abutment is shifted in a radial direction depending on the correction or regulation discussed earlier.

In other words, for a given wear component the most appropriate removable abutment may be chosen to ensure a proper secondary sleeve-frame retention.

For example, a base 40 of the removable abutment 36 is inserted in an undercut seat 38 of the firearm frame 2.

Optionally, the firearm 1 could comprise releasable locking means 64 of the detachable abutment 36 to the firearm frame 2, for example at least one screw or dowel screw. In the variant shown, the releasable locking means 64 are inserted in a through seat 78 of the removable abutment 36 (for example threaded seat), which crosses the thickness of the latter.

Preferably, the undercut seat 38 comprises one or more inclined surfaces 76 on which said means 64 act in thrust to retain the removable abutment in the seat 38.

For example, the embodiment shown in the drawings illustrates a pair of inclined surfaces 76 transversely distanced in the firearm.

Advantageously, the inclined surface 76 is made in the bottom wall 20 of the frame 2 and, specifically, extends along an inclined plane I (FIG. 4) incident to the longitudinal direction X with an acute angle, when the barrel sleeve is positioned in the closed configuration.

Figure 3:
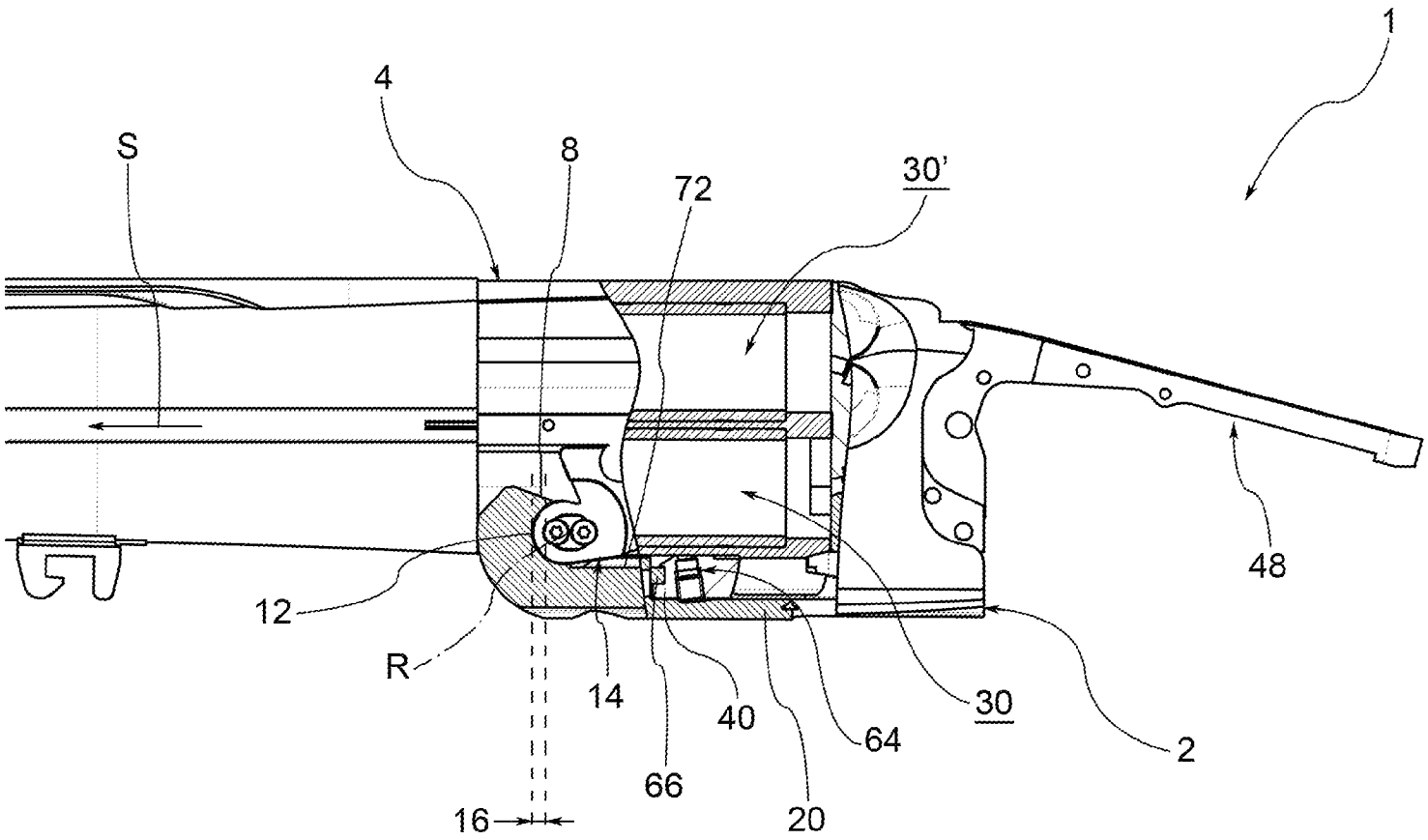
FIGS. 3 and 4 are side views partly in cross-section through the frame of the firearm and the barrel sleeve respectively, in a closed configuration and in an open configuration of at least one firing chamber.
Figure 4:
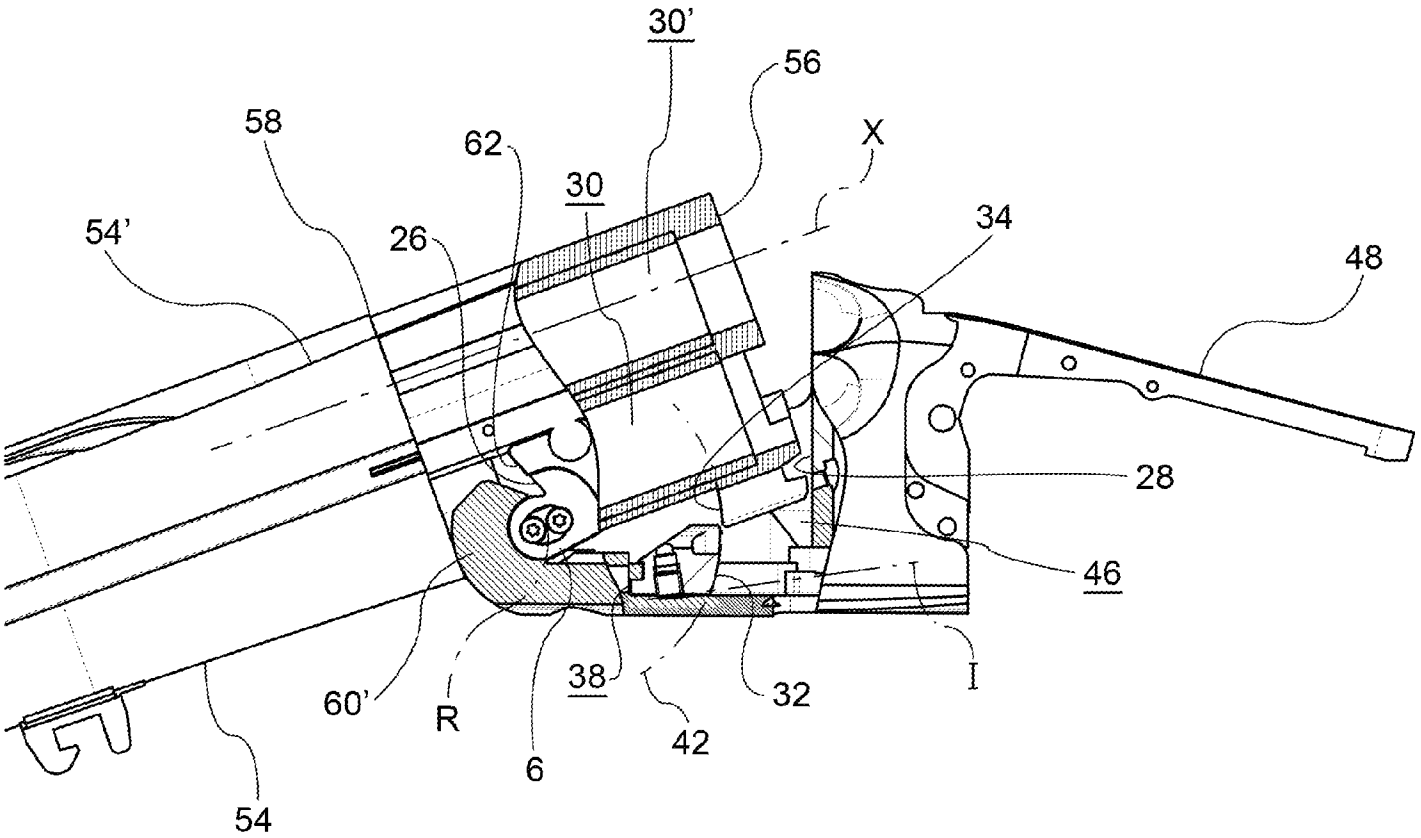

For example with reference to the variant in FIG. 3, a part of the base 40 is inserted in the seat 38 placing itself under a retention lip 66 of the firearm frame. Since the inclined surface 76 is facing the retention lip, when the releasable locking means 64 act in thrust on said surface, the removable abutment 36 will be pushed towards the retention lip 66 thereby securing said abutment firmly to the firearm frame.

Preferably, a separation line 42 between the retention surfaces 32, 34 extends at least partially along an arc of a circle centred at the rotation axis R.

In the embodiments shown, the detachable abutment 36 is divided into a pair of reinforcement peaks 44, 44', between which a firing chamber 30, 30' of the barrel sleeve 4 is reversibly insertable.

In other words, in this variant, the aforesaid peaks are transversely distanced from each other so as to define an insertion space 68 for a portion of the sleeve.

Advantageously, a depression 70 delimited between said peaks has a depth approximately equal to a bottom surface 72 of the firearm frame.

The present invention also relates to a firearm kit which comprises one or more wear components 14 connectable in a releasable manner to a rotation pin 6, 6', to a firearm frame 2 and/or to a barrel sleeve 4 of the firearm 1 according to any of the above embodiments, and one or more removable abutments 36 for such firearm 1.

As regards the preferred or advantageous features of such kit, reference is made to the embodiments above.

Advantageously, the firearm of the present invention makes it possible to greatly facilitate the assembly and maintenance operations of the rotation pin.

Advantageously, the firearm of the present invention has a longer useful life than conventional firearms.

Advantageously, the firearm of the present invention is constructionally simple, therefore suitable to be manufactured inexpensively.

Advantageously, the firearm of the present invention is configured to distribute the forces evenly along the sliding surfaces, so as to reduce the impact of the mechanical stresses to which they are subjected.

Advantageously, the firearm of the present invention has been designed to faithfully maintain its operating configurations.

Advantageously, the firearm of the present invention has reliable mechanical and anti-rotation couplings.

A person skilled in the art may make variations to the aforementioned embodiments of the firearm and of the kit, or replace elements with others functionally equivalent so as to satisfy specific requirements.

Such variants are also contained within the scope of protection as defined by the following claims.

In addition, each variant described as belonging to a possible embodiment may be realised independently of the other embodiments described.

What is claimed is:

1. A firearm comprising:

a firearm frame;

a barrel sleeve, which extends in a longitudinal direction and which is mounted in a rotatable manner on the firearm frame;

at least one rotation pin which extends between the firearm frame and the barrel sleeve to guide said sleeve around a rotation axis;

wherein the rotation pin and the firearm frame lie in abutment with each other by means of complementary sliding surfaces, at least one sliding surface being carried by a wear component connected in a releasable manner to the rotation pin;

and wherein the barrel sleeve is rotatable between a closed configuration wherein said barrel sleeve and an inner surface of the firearm frame act in conjunction to close at least one firing chamber of the firearm, and an open configuration wherein the sleeve is distanced from said surface.

2. The firearm according to claim 1, wherein the wear component has variable dimensions to correct or regulate a lever arm of the barrel sleeve, following a wear of the sliding surfaces.

3. The firearm according to claim 1, wherein, with respect to the rotation axis, the wear component forms a predefined radial thickness to correct or regulate the distance between the sliding surface thereof and the rotation axis.

4. The firearm according to claim 1, wherein the material which the wear component is composed of is the same as that which the firearm frame is made of, or is a material of a hardness at least comparable to said frame.

5. The firearm according to claim 1, wherein the wear component is joined to the rotation pin, and wherein the sliding surface carried by said component works on an opposite sliding surface made in one piece with the firearm frame.

6. The firearm according to claim 1, wherein the rotation pin is made in one piece with the barrel sleeve, or wherein the wear component is coupled by means of a shaped coupling to the rotation pin to form therewith a prismatic torque.

7. The firearm according to claim 1, wherein the wear component comprises at least one tooth projecting in a radial direction—relative to the rotation axis—which delimits a tooth surface alongside and rearward in relation to an end-stroke surface of the barrel sleeve on the firearm frame, to limit the angle of rotation of said sleeve.

8. The firearm according to claim 1, wherein the barrel sleeve and the firearm frame delimit opposite retention surfaces which, when said sleeve is positioned in the closed configuration, interact to retain said sleeve in a firing direction of the firearm, at least one of said surfaces being delimited by a removable abutment shaped correspondingly to the wear component.

9. The firearm according to claim 8, wherein the removable abutment is placed in a seat of the firearm frame at a fixed radial distance from the rotation axis, and wherein the retention surface of said abutment is shifted in a radial direction depending on a desired correction or regulation of a lever arm of the barrel sleeve or of a distance between the respective sliding surface and the rotation axis.

10. The firearm according to claim 8, comprising releasable locking means of the removable abutment to the firearm frame, wherein a base of the removable abutment is inserted in an undercut seat of said frame, wherein said seat comprises one or more inclined surfaces on which said locking means act in thrust to retain the removable abutment in said seat.

11. The firearm according to claim 8, wherein a separation line between the retention surfaces extends at least partially along an arc of a circle centered at the rotation axis.

12. The firearm according to claim 8, wherein the detachable abutment is divided into a pair of reinforcement peaks, between which a firing chamber of the barrel sleeve is reversibly inserted.

13. The firearm according to claim 1, characterized in that it is a rifle with one, two or three barrels.

14. The firearm according to claim 13, wherein the two or three barrels are adjacent or superposed.

* * * * *